US006890406B2

(12) United States Patent
Aho

(10) Patent No.: US 6,890,406 B2
(45) Date of Patent: May 10, 2005

(54) METHOD AND APPARATUS FOR TIGHTENING A SHOE PRESS ROLL MANTLE AND/OR REDUCING ITS WEAR

(75) Inventor: Erkki Aho, Elimäki (FI)

(73) Assignee: Vaahto Oy, Hollola (FI)

( * ) Notice: Subject to any disclaimer, the term of this patent is extended or adjusted under 35 U.S.C. 154(b) by 273 days.

(21) Appl. No.: 10/185,093

(22) Filed: Jul. 1, 2002

(65) Prior Publication Data

US 2003/0024416 A1 Feb. 6, 2003

(30) Foreign Application Priority Data

Jul. 5, 2001 (FI) ..... 20011475

(51) Int. Cl.[7] ..... D21F 3/08

(52) U.S. Cl. ..... 162/199; 162/272; 162/358.3; 427/16; 427/47

(58) Field of Search ..... 162/199, 272, 162/358.3; 492/16, 47

(56) References Cited

U.S. PATENT DOCUMENTS 5,084,137 A 1/1992 Ilmarinen et al.
5,643,416 A 7/1997 Lange et al.
5,775,564 A 7/1998 Ilmarinen
5,900,118 A 5/1999 Breiten

FOREIGN PATENT DOCUMENTS

FI 100012 B 5/1997
FI 101319 B 7/1998

*Primary Examiner*—Peter Chin
(74) *Attorney, Agent, or Firm*—Birch, Stewart, Kolasch & Birch, LLP

(57) ABSTRACT

A method for tightening a shoe press roll mantle and/or reducing its wear, in which method the shoe press used comprises a press roll (1) and a backing roll, said press roll (1) comprising a rotating, liquid-impermeable roll mantle (2), a solid and preferably non-rotatable support beam (3) going axially through the roll mantle and having a stub shaft (4, 5) at each end of it, at least one press shoe supported by the support beam and having a concave surface part, elements for pressing the concave surface part against the roll mantle so that the mantle together with the backing roll can form a pressing zone, two roll mantle end pieces (6, 7) axially movable on each stub shaft, fastening elements for fastening the axial ends of the roll mantle to each roll mantle end piece, and at least one element for tightening the elastic roll mantle and/or moving it axially on each respective stub shaft. The roll mantle is tightened and/or displaced by means of a common actuator (8) functionally connected to both roll mantle end pieces, both roll mantle end pieces (6, 7) being moved simultaneously by said actuator.

15 Claims, 3 Drawing Sheets

Figure 1:
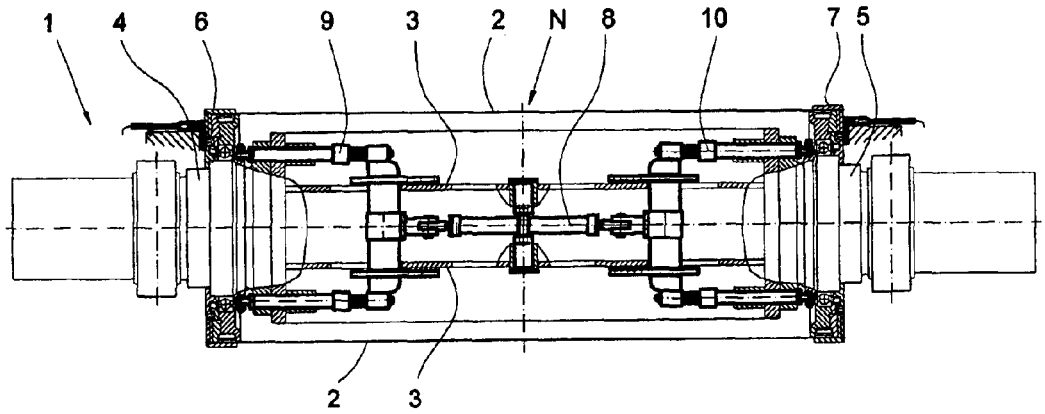

METHOD AND APPARATUS FOR TIGHTENING A SHOE PRESS ROLL MANTLE AND/OR REDUCING ITS WEAR

The present invention relates to a method and an apparatus as defined in the preambles of the independent claims presented below for tightening the roll mantle of a shoe press and/or reducing its wear.

A typical shoe press comprises a press roll and a backing roll, and the press roll comprises a flexible rotating roll mantle impermeable to liquid, a fixed and preferably non-rotatable support beam going axially through the roll mantle and having a stub shaft at each end of it, at least one press shoe supported by the support beam and having a concave surface part, elements for pressing the concave surface part against the elastic roll mantle so that the mantle together with the backing roll can form a pressing zone, two roll mantle end pieces axially movable on each stub shaft, fastening elements for fastening the axial ends of the roll mantle to each roll mantle end piece, and at least one element for tightening the elastic roll mantle and/or moving it axially on each respective stub shaft. The elastic roll mantle may have properties permitting stretching in the widthways direction of the machine during operation or the roll mantle may be of substantially constant width.

It is generally known that the roll mantle of a shoe press as described above has to be tightened during operation. Another known problem with a long nip type press as described above is wear of the roll mantle in the region of the axial ends of the press shoe, which is a consequence of the large local stresses that the roll mantle undergoes as it passes through the press zone. Therefore, the useful life of the roll mantle is short and the mantle has to be replaced at regular intervals, leading to interruptions and reduction of production.

An example of solutions designed to eliminate the above-described problem is that presented in patent specification FI 100012. This specification discloses an apparatus in which the roll mantle is moved manually in the axial direction by means of mechanical retainers about once a week. The tightening of the roll mantle is performed using hydraulic cylinders. The hydraulic cylinders are so fitted that they only act on one end of the roll mantle while its other end remains locked in place. When the roll mantle has been stretched by a certain length, it is moved into a new position while the tightening is active all the time. A mantle stretching mechanism is used for functional reasons to keep the roll mantle in shape. In the apparatus described in the specification, the elongation of the roll mantle is not utilized in any way, but the mantle stretching apparatus is only used to keep the roll mantle functional as it tends to stretch during operation.

Patent specification FI 101319 discloses a method and apparatus designed to eliminate the problems associated with the apparatus of the above-described specification, in which method one end of the roll mantle is first locked in place and the second end is acted on by a an actuator, whereupon the second end is locked in place and the roll mantle is stretched in the opposite direction. The stretching direction is changed automatically after a given elongation or period of time. The apparatus presented in this specification comprises actuators at each end of the roll mantle, which are used to stretch the roll mantle alternately in opposite directions.

In the apparatuses described above, the hydraulic actuators used to stress the roll mantle are mounted on the surface of the support beam, and in order to achieve a uniform stress, probably at least three actuators are needed for each end. The use of a plurality of separate actuators increases the space requirement and need for maintenance of the system, resulting in a complicated system.

The object of the method and apparatus of the present invention is to eliminate or at least to reduce the problems associated with the above-described prior-art solutions.

A further object of the invention is to achieve a method and an apparatus for tightening the roll mantle of a shoe press and/or reducing its wear, which can be used with both stretchable and non-stretchable roll mantles. An additional object is to achieve an apparatus that is simple and reliable in respect of operation as well as control.

To implement the aforesaid objects, among other things, the method and apparatus of the invention for tightening a shoe press roll mantle and/or reducing its wear are mainly characterized by what is said in the characterization parts of the independent claims presented below.

A feature typical of the method of the invention is that, as a means for tightening and/or displacing the roll mantle axially on the respective stub shaft, at least one actuator disposed inside the support beam and functionally connected to both roll mantle end pieces is used to move both roll mantle end pieces simultaneously relative to each other. The actuator disposed inside the support beam and functionally connected to the roll mantle end pieces consists of a three-chamber pressure-medium operated cylinder, the pressure ratios between the chambers of which are varied. In the method of the invention, instead of a three-chamber cylinder, it is also possible to use a cylinder with more than three chambers or a number of two-chamber cylinders connected in series. 'Three-chamber cylinder' in the present context refers e.g. to a cylinder comprising two movable pistons and three pressure medium spaces, the pistons being moved by varying the pressure in each chamber. The cylinder, preferably a hydraulic cylinder, is immovably locked in place on the center line of the machine.

The main advantage afforded by the method of the invention is that, by placing the actuator moving the roll mantle end pieces inside the support beam, the displacement of the roll mantle end pieces can be advantageously implemented using a single actuator. This allows cost and space savings to be achieved.

In a preferred method according to the present invention, the tightening of the roll mantle is performed by controlling the pressure in the middle chamber of a three-chamber cylinder. Controlling the pressure in a chamber here means that the chamber is supplied with a pressure medium in such manner that a desired pressure is maintained in the chamber. The middle chamber is set to a higher pressure than the outer chambers. The pistons of the actuator are forced to move simultaneously in opposite directions, and correspondingly the roll mantle end pieces are moved in opposite directions and the roll mantle is tightened. By reducing the pressure prevailing in the middle chamber, the roll mantle becomes slacker or its slackening becomes possible. Very preferably a substantially constant pressure is maintained in the middle chamber during operation of the shoe press. Thus, the roll mantle end pieces tend to move simultaneously in opposite directions with uniform force and the roll mantle is acted on by a steady force that tightens the roll mantle. When a mantle stretchable during operation of the shoe press is used, the pressure in the middle chamber changes, so the chamber needs to be held at constant pressure to keep the tightness substantially constant. As the roll mantle is tightened simultaneously in both directions, the roll mantle undergoes uniform elongation. The pressures in the outer chambers are also kept substantially constant during operation.

In a preferred method according to the present invention, the roll mantle is displaced laterally and the tightness of the roll mantle is adjusted by increasing and decreasing the pressures in the three-chamber cylinder. When constant pressures are maintained in all three cylinders, the tightness of the roll mantle remains constant and its position on the center axis relative to the center line N of the link bushing remains the same. When the pressure in the middle chamber is raised or lowered while the pressure in the outer chambers remains constant, the roll mantle end pieces correspondingly move simultaneously towards each other or away from each other, with the roll mantle remaining laterally in place relative to the center axis. When the pressure in one of the outer chambers is increased and in the other one decreased by equal amounts, the roll mantle end pieces move in the desired manner in relation to the center line N of the link bushing.

Thus, the roll mantle can be moved at desired intervals, thereby reducing wear of the mantle and extending its service life. A stretchable roll mantle is first allowed to stretch in both directions relative to the center line of the machine, keeping the roll mantle in the middle of it. After a certain period of time, when the roll mantle stops stretching, stepwise adjustment relative to the center line of the machine is adopted and the roll mantle is moved in one direction up to an end limit, whereupon the direction of stepwise adjustment of the roll mantle is changed. In stepwise adjustment, the roll mantle is moved from left to right and from right to left by moving both roll mantle end pieces simultaneously. In addition, by implementing the displacement of the roll mantle in the above-described manner, a substantially constant roll mantle tightness is maintained both during the displacement and during the change of direction of displacement.

When the roll mantle is of a type that stretches during operation of the shoe press, it does not necessarily have to be moved to reduce wear of the roll mantle. By virtue of the fact that the roll mantle is tightened simultaneously in opposite directions according to the present invention and because the roll mantle stretches, those areas of the roll mantle that are subjected to greatest stress move away from the points of greatest stress, i.e. from the edge of the shoe imposing a stress on the roll mantle.

In the method of the present invention, very preferably one or more measuring sensors are used to determine the position of at least one of the roll mantle end pieces. The measuring sensor may be e.g. an inductive sensor that measures the position of the end piece or it may be a mechanical limit switch that gives a signal when the end piece reaches a given limit. The measuring sensor may also be coupled with the cylinder itself or it may be so connected to it that the position of at least one of the pistons and therefore the position of the end piece attached to it can be measured. On the basis of the position data obtained from the measuring sensor, the pressures in the outer chambers are controlled, thereby moving the roll mantle in a desired direction or to a desired position.

In a very preferable method according to the present invention, the middle chamber of the actuator applying a load to the roll mantle end pieces and tightening the roll mantle is set to an idle state to facilitate replacement of the roll mantle. In this state, the roll mantle end pieces can be moved freely and the person performing the replacement of roll mantle can e.g. manually move the end piece to a position advantageous in regard of roll mantle replacement. By reducing or "resetting" the chamber pressures, it is also possible to bring the end pieces to a completely retracted position or to a desired position while the roll mantle is being replaced.

A feature typical of the apparatus of the invention is that the apparatus comprises at least one actuator disposed inside the support beam and functionally connected to the roll mantle end pieces so as to allow the roll mantle end pieces to be moved simultaneously relative to each other to tighten the roll mantle and/or to move it axially on each respective stub shaft. The apparatus of the invention is based on the insight that, by mounting the actuators stressing the roll mantle end pieces inside the support beam and connecting them to the roll mantle end pieces, the apparatus can be implemented very advantageously using a single pressure-medium operated three-chamber actuator, such as a hydraulic cylinder. In this way, a space saving is achieved and the control system can be implemented in more simple manner than in prior-art apparatus.

In the framework of the present invention, it is also possible to implement an embodiment in which, instead of a three-chamber actuator as described above, it is also possible to use e.g. a cylinder having more than three chambers or prior-art two-chamber actuators connected in series, unlike state-of-the-art devices.

The actuator mounted inside the support beam is preferably connected to the support beam via pivotal joints. The pivotal joints are very preferably implemented on the center line of the actuator. Likewise, the means connecting the actuator to the roll mantle end piece also comprise pivotal joints. The aforesaid pivotal joints provide the advantage that eventual bending of the support beam will not cause any problems affecting the operation of the apparatus.

Figure 2:
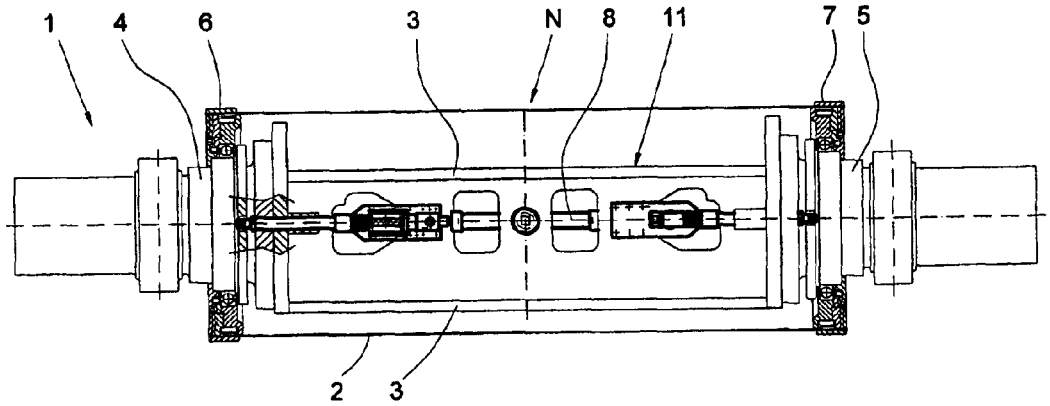
Figure 3:
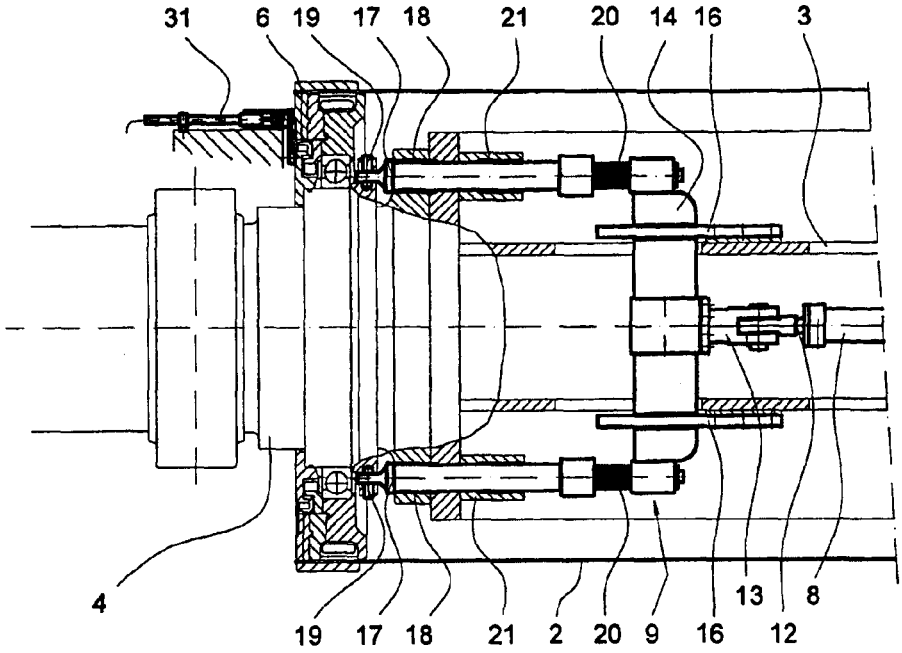
Figure 4:
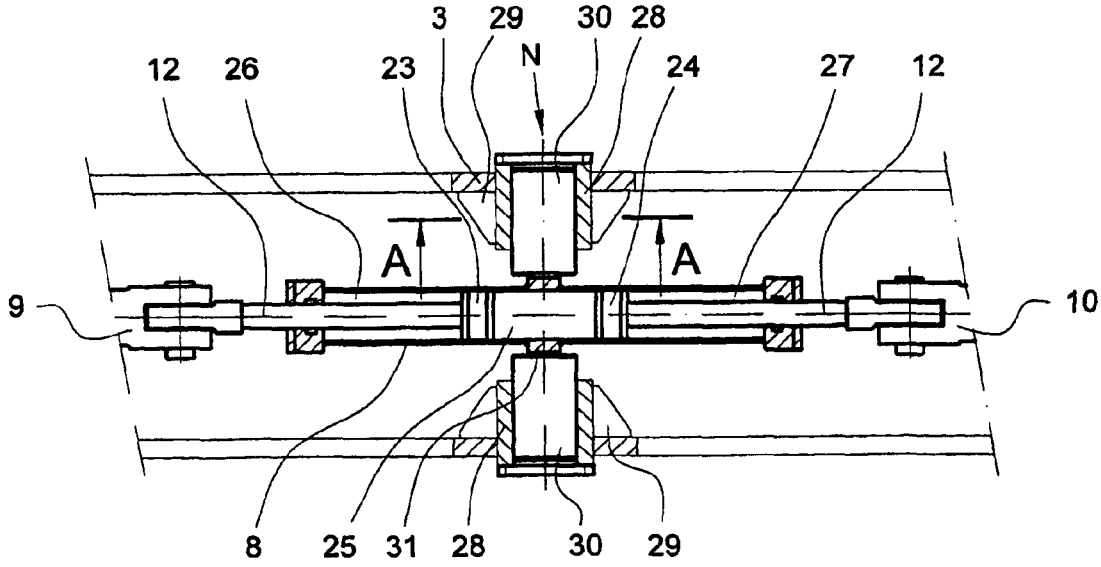
Figure 5:
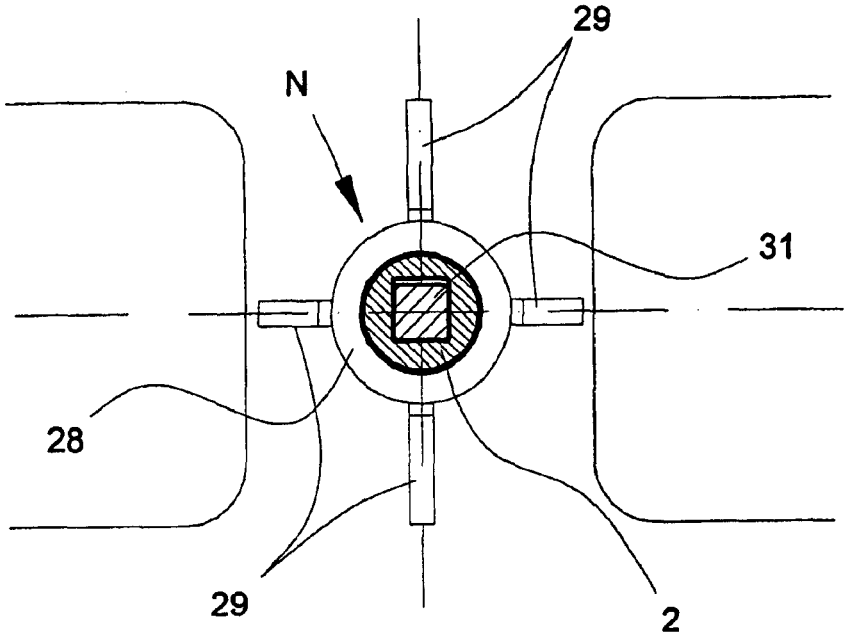
Figure 6:
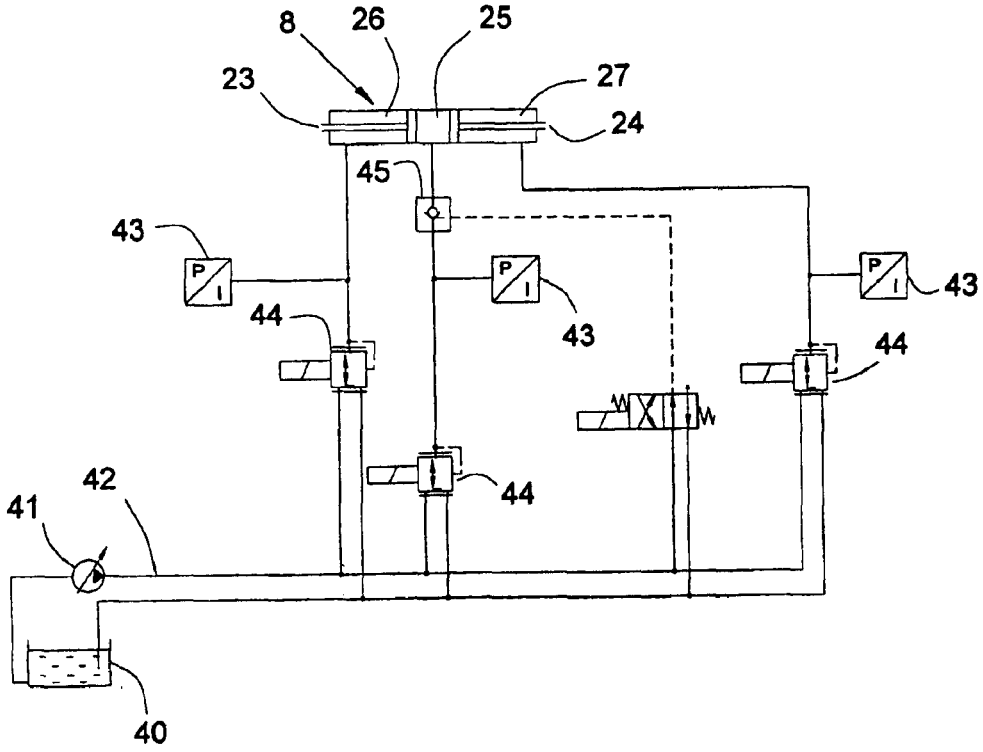

In the following, the invention will be described in detail with reference to the attached drawing, wherein FIG. 1 presents a diagrammatic partial section of the press roll of a shoe press as seen from above the roll, FIG. 2 presents a diagrammatic side view of the press roll shown in FIG. 1, FIG. 3 presents a magnified view of one of the end parts of the press roll shown in FIG. 1, FIG. 4 presents a magnified cross-section of the actuator shown in FIG. 1, FIG. 5 presents section A—A of FIG. 4, and FIG. 6 presents a diagrammatic example of a pressure medium system.

In FIGS. 1 and 2, the structure of the press roll 1 of a shoe press, i.e. a long nip press, is presented by way of example and in a diagrammatic form. The press roll comprises a sleeve-like roll mantle 2 made of elastic material, a fixed non-rotatable support beam 3 going axially through the roll mantle and having a stub shaft 4 and 5 at each end of it. Fitted with bearings on the stub shafts 4 and 5 are two roll mantle end pieces 6 and 7, which can be moved axially on each stub shaft. The axial ends of the roll mantle 2 are attached by means of fastening elements to each roll mantle end piece. As shown in the figure, the press roll additionally comprises a pressure-medium operated actuator pivotally mounted inside the support beam 3 on the center line N, i.e. a hydraulic cylinder 8 in the embodiment example presented in the figure. The cylinder 8 is coupled to each roll mantle end piece via coupling means 9 and 10.

In addition to the elements shown in the figure, the press roll also comprises at least one shoe having a concave surface part, and means for pressing the concave surface part against the elastic roll mantle 2, so that the roll mantle will assume a shape determined by the concave surface part of the shoe and a backing roll placed against the press roll and that the roll mantle together with the backing roll can form a press zone, through which the paper or cardboard web can be passed to remove water from the web. The shoe and the elements pressing the shoe can be fitted on the surface 11 of the support beam 3 of the press roll.

FIG. 3 presents a magnified view of the linkage between the cylinder 8 and the roll mantle end piece 6, implemented using coupling means 9, the components of which will be described next. The end of the piston rod 12 of the cylinder 8 is pivotally connected by a link 13 to a cross-arm 14, which transmits the motion of the piston 12 out of the support beam 3 through holes 15 provided in the sides of the support beam 3. Fitted beside the holes 15 in connection with the cross arm 14 are holding elements 16 serving to prevent the piston rod and the cross-arm linked to it from rotating about the longitudinal axis of the piston rod. Attached to the cross-arm 14 are two axial arms 17, which are passed through holes 18 in the end portion of the stub shaft 4 to the roll mantle end piece and fastened to the surface of the end piece on the center axis of the roll mantle end piece by fastening elements 19. The axial arms 17 are provided with helical springs 20 to allow springing action. Instead of helical springs, it would be possible to use e.g. cup springs. The purpose of the springing of the axial arms is to partially tighten the roll mantle. By means of the pressure-medium operated actuator, the rigidity of the springs is held at a desired value so that the roll mantle is acted on by a force of a desired magnitude. Mounted as extensions of the holes 18 are reinforcing bushes 21 serving to support the axial arms and prevent them from buckling when the roll mantle end piece is being moved. The length of the axial arms and the reinforcing bushes supporting them varies according to the length of the press roll. The axial arms may also be provided with additional supports, e.g. reinforcing bushes, fixed to the outer surface of the support beam 3. Via the coupling means, the motion of the piston rods can be transmitted to the roll mantle end pieces, causing the roll mantle end pieces to move axially on the stub shaft 4 simultaneously relative to each other. The cylinder 8 is also coupled to the other roll mantle end piece 7 in a corresponding manner as described above.

FIG. 3 also presents means for measuring the position of the roll mantle end piece 6. The measurement of the position of the roll mantle end piece is implemented using a linear sensor 31, whose sensor part is connected to the machine frame while its measuring head is connected to the roll mantle end piece 6. The other roll mantle end piece is also provided with a corresponding linear sensor. The measurement of the position of the roll mantle can also be implemented using one or more measuring sensors of some other type, e.g. position detectors or limit detectors. The measuring sensor may be functionally connected directly to the roll mantle end piece, in which case the measuring sensor can be mounted on the surface of the stub shaft 4 and 5 or it may be arranged to measure the position of the pistons of the cylinder connected to the roll mantle end pieces or the position of some other actuator or a part of one. The measuring sensor used may be e.g. an inductive sensor or a mechanical limit switch.

FIG. 4 presents a magnified cross-section of a three-chamber cylinder 8 pivotally connected to the support beam 3 at pivot point N. The cylinder 8 comprises a tubular shell structure 22 with cylinder ends, said shell structure and cylinder ends defining the interior space of the cylinder. Placed inside the cylinder are two pistons 23 and 24, whose piston rods 12 pass through the cylinder ends and are linked to the coupling means 9 and 10. Inside the cylinder between the pistons is an intermediate space forming the middle chamber 25 of the cylinder. Between the pistons 23 and 24 and the cylinder ends are end spaces forming a left chamber 26 of the cylinder and a right chamber 27 of the cylinder, respectively. A pressure medium can be supplied into all these chambers and removed from them by hydraulic means, which have been omitted from the figure to clarify the drawing. These aforesaid hydraulic means include various hoses, pipes, valves, pumps and motors, which are used and controlled to control the pressure in the chambers.

As illustrated in FIGS. 4 and 5, the cylinder 8 is connected to the support beam 3 at pivot point N with a hinge structure comprising and supporting collars 28 defining holes on opposite sides of the support beam. The supporting collars 28 are supported inside the support beam by brackets 29. Fitted through the supporting collar 28 from outside the support beam to the inside of the support beam is a pivot sleeve 30 designed to be rotatable relative to the supporting collar, said pivot sleeve being connected to a stud 31 fitted on the outer surface of the cylinder, at the midpoint of the cylinder. The interior space of the pivot sleeve 30 has an angular shape, and the similarly angular stud fitted into the pivot sleeve does not rotate in the pivot sleeve, but the cylinder, being supported by the pivot sleeve, turns relative to the support beam.

FIG. 6 presents a diagrammatic example of a pressure medium system for use in the method and apparatus of the invention. For the control of the three-chamber cylinder 8, the system comprises a container 40 from which a pressure medium, such as e.g. hydraulic oil, pressurized by a regulating pump 41 is fed into a supply line 42 and passed via branchings into the middle chamber 25 of the cylinder and into its outer chambers, i.e. into the left-hand chamber 26 and the right-hand chamber 27 as presented in the drawing, to control the motion of the pistons 23 and 24 of the cylinder. The regulating pump 41 maintains a constant pressure in the supply line. Connected to branches of the supply line are pressure-measuring means 43 for measuring the pressure prevailing in the chambers, said means being connected to the control system (not shown in the drawing) controlling the pressure medium system. The above-mentioned position sensors detecting the position of the roll mantle end pieces are also connected to the control system to supply the system with roll mantle end piece position data. Placed in the branches of the supply line are proportional pressure reduction valves 44 controlled by the control system and serving to set the pressure prevailing in the chambers. In addition, the branches leading into the outer chambers are provided with counter valves 45 controlled by the control system with a control pressure, allowing the pressure in the outer chambers to be reduced.

In the following, the operation of the method and apparatus of the invention during application of the press roll will be described. After the roll mantle 2 of the press roll 1 has been changed and fastened to the roll mantle end pieces 6 and 7, a constant-level air pressure is supplied into the space inside the roll mantle 2 and the roll mantle is tightened. The tightening of the roll mantle 2 is performed by pressurizing the middle chamber 25 of the three-chamber cylinder 8 and, if necessary, supplying the outer chambers 26 and 27 of the cylinder with a suitable counter pressure. After the pressures have been set, the pistons 23 and 24 of the cylinder move away from each other, pushing the roll mantle end pieces 6 and 7 simultaneously in opposite directions so that the roll mantle 2 attached to the roll mantle end pieces is tightened. The roll mantle end piece is tightened to a desired tightness and centered to the center line of the machine. The tightness of the roll mantle can be measured when necessary e.g. by measuring the pressures prevailing in the middle and outer cylinders and comparing the chamber pressures to each other. After the roll mantle has been tightened, the pressure in the middle chamber is kept substantially constant.

When the roll mantle is of a type stretchable during operation of the press roll, the pistons of the cylinder move further apart, with the result that the pressure in the middle chamber changes, which is why, to maintain a constant tightness of the roll mantle, the pressure of the pressure medium supplied into the middle chamber needs to be adjusted to maintain a correct tightness.

When the roll mantle is to be displaced e.g. to reduce its wear, the middle chamber 25 is still maintained at constant pressure and the chamber 25 is locked for the time of the displacement process, and the pressures in the outer chambers 26 and 27 are altered. The pressure in one of the outer chambers is increased while the pressure in the other one is simultaneously decreased, with the result that the end pieces move simultaneously in the desired direction. After the desired step value has been reached, the motion stops and the pressures are set to the normal constant level and the middle chamber 25 is released from its locked state. The roll mantle is then kept in position until the next period. The lateral displacement of the roll mantle is implemented as periodic and stepwise displacement. The length of the period as well as the magnitude of the step value are selected as desired.

The roll mantle can be moved in the manner described above e.g. using incremental adjustment with adjustment settings towards one of the end pieces until the roll mantle reaches a predetermined limit value. Incremental adjustment means that the roll mantle is displaced relatively quickly by an amount corresponding to the adjustment setting, e.g. two millimeters. The period between adjustments may be e.g. 1 . . . 7 days. When the roll mantle is in one of its extreme positions, the direction of displacement is reversed.

The invention is by no means restricted to the embodiment described above; instead, it can be varied within the scope of the inventive idea disclosed in the claims.

What is claimed is:

1. Method for tightening a shoe press roll mantle and/or reducing its wear, in which method the shoe press used comprises a press roll (1) and a backing roll, said press roll (1) comprising a rotating, liquid-impermeable elastic roll mantle (2), a solid non-rotatable support beam (3) going axially through the roll mantle and having a stub shaft (4, 5) at each end of it, at least one press shoe supported by the support beam and having a concave surface part, elements for pressing the concave surface part against the roll mantle so that the mantle together with the backing roll can form a pressing zone, two roll mantle end pieces (6, 7) axially movable on each stub shaft, fastening elements for fastening the axial ends of the roll mantle to each roll mantle end piece, and at least one element for tightening the elastic roll mantle and/or moving it axially on each respective stub shaft, comprising the following steps:

tightening and/or displacing the roll mantle by means of a common actuator (8) functionally connected to both roll mantle end pieces, and moving both roll mantle end pieces (6, 7) simultaneously by said actuator.

2. Method according to claim 1, wherein, to tighten and/or to displace the roll mantle, a multi-chamber pressure-medium operated actuator of a cylindrical design is used, the relationships between the chamber pressures being varied to displace the roll mantle end pieces (6, 7).

3. Method according to claim 1, wherein said actuator is a 3-chamber cylinder and the tightening of the roll mantle is performed by controlling the pressure of the middle chamber (25) of the three-chamber cylinder in relation to the pressures in the outer chambers (26, 27).

4. Method according to claim 3, wherein the pressure in the middle chamber (25) is kept substantially constant during operation of the shoe press.

5. Method according to claim 2, wherein the multi-chamber actuator is a 3-chamber cylinder and the roll mantle (2) is displaced by adjusting the pressures in outer chambers (26, 27) of the three-chamber cylinder (8) simultaneously in opposite directions and keeping the pressure in the middle chamber (25) constant and locked during the displacement.

6. Method according to claim 1, wherein said actuator is a 3-chamber pressure-medium operated actuator, setting the middle chamber on the actuator into a free state, to bring the roll mantle end pieces (6, 7) into a position to permit replacement of the roll mantle (2).

7. Apparatus for tightening a shoe press roll mantle and/or reducing its wear, said shoe press comprising a press roll (1) and a backing roll, said press roll (1) comprising a rotating, liquid-impermeable elastic roll mantle (2), a solid non-rotatable support beam (3) going axially through the roll mantle and having a stub shaft (4, 5) at each end of it, at least one press shoe supported by the support beam and having a concave surface part, elements for pressing the concave surface part against the roll mantle so that the mantle together with the backing roll can form a pressing zone, two roll mantle end pieces (6, 7) axially displaceable on each stub shaft, fastening elements for fastening the axial ends of the roll mantle to each roll mantle end piece, and at least one element for tightening the elastic roll mantle and/or displacing it axially on each respective stub shaft, characterized in that the apparatus comprises at least one common actuator (8) functionally connected to both roll mantle end pieces for moving both roll mantle end pieces (6, 7) simultaneously in order to achieve a tightening of the roll mantle (3) and/or its displacement on each respective stub shaft (4, 5).

8. Apparatus according to claim 7, wherein the actuator (8) is pivotally mounted on the support beam (3) substantially on its center line.

9. Apparatus according to claim 7, wherein the actuator comprises a three-chamber pressure-medium operated cylinder (8).

10. Apparatus according to claim 7, wherein the actuator comprises at least two series-connected pressure-medium operated cylinders functionally connected to the roll mantle end pieces to move the roll mantle end pieces simultaneously relative to each other in order to tighten the roll mantle and/or to displace it axially on each respective stub shaft.

11. Apparatus according to claim 7, wherein the apparatus comprises means for controlling and adjusting the pressures in the chambers of the three-chamber cylinder or series-connected cylinders.

12. Apparatus according to claim 7, wherein the apparatus comprises means for measuring the position of at least one of the roll mantle end pieces (6, 7).

13. Apparatus according to claim 12, wherein the means for measuring the position of the roll mantle end piece comprises a linear sensor (31) disposed between the frame part of the shoe press and the roll mantle end piece.

14. Apparatus according to claim 12, wherein the means for measuring the position of the roll mantle end piece comprises a measuring sensor that senses the position of the roll mantle end piece, preferably by an inductive method.

15. Apparatus according to claim 7, wherein the apparatus comprises means for controlling the actuator moving the roll mantle end pieces to move the roll mantle end pieces on the basis of the roll mantle end piece position data.

* * * * *